US010881923B2

(12) United States Patent
Norimura

(10) Patent No.: US 10,881,923 B2
(45) Date of Patent: Jan. 5, 2021

(54) IRON TYPE GOLF CLUB HEAD AND IRON TYPE GOLF CLUB SET

(71) Applicant: Sumitomo Rubber Industries, Ltd., Hyogo (JP)

(72) Inventor: Takahiro Norimura, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 16/575,448

(22) Filed: Sep. 19, 2019

(65) Prior Publication Data

US 2020/0101355 A1 Apr. 2, 2020

(30) Foreign Application Priority Data

Sep. 28, 2018 (JP) ..... 2018-184759

(51) Int. Cl.
*A63B 53/04* (2015.01)
*A63B 102/32* (2015.01)

(52) U.S. Cl.
CPC ..... *A63B 53/047* (2013.01); *A63B 53/04* (2013.01); *A63B 53/0408* (2020.08); *A63B 53/0433* (2020.08); *A63B 2053/0491* (2013.01); *A63B 2102/32* (2015.10)

(58) Field of Classification Search
CPC .... A63B 2053/0433; A63B 2053/0491; A63B 2053/0408; A63B 53/047; A63B 53/04
USPC ..... 473/338, 344, 341
See application file for complete search history.

(56) References Cited

U.S. PATENT DOCUMENTS

2013/0324280 A1* 12/2013 Boyd ..... B29C 45/1671 473/290
2016/0101330 A1* 4/2016 Harrington ..... A63B 53/047 473/338
2016/0184665 A1* 6/2016 Nakamura ..... A63B 53/047 473/335
2017/0173414 A1* 6/2017 Motokawa ..... A63B 60/50
2017/0312590 A1* 11/2017 Nakamura ..... A63B 60/50
2018/0001157 A1* 1/2018 Abe ..... A63B 53/047
2018/0001169 A1 1/2018 Abe
2019/0015710 A1* 1/2019 Norimura ..... A63B 53/0475

FOREIGN PATENT DOCUMENTS

JP 2018-000471 A 1/2018

* cited by examiner

*Primary Examiner* — Benjamin Layno
(74) *Attorney, Agent, or Firm* — Studebaker & Brackett PC

(57) ABSTRACT

An iron type golf club head has a club face provided with face lines and comprises an external weight member secured to a sole portion of a head main body and having a specific gravity larger than the head main body. The external weight member has a center of gravity located on the toe side of the middle point in the toe-heel direction of the face lines, and comprises a wide portion and a narrow portion located on the heel side of the wide portion. The wide portion is located on the toe side of the above-mentioned middle point. The wide portion has a front edge extending along the leading edge of the sole portion, and the narrow portion has a front edge extending along the leading edge and located backward of the front edge of the wide portion.

19 Claims, 10 Drawing Sheets

IRON TYPE GOLF CLUB HEAD AND IRON TYPE GOLF CLUB SET

TECHNICAL FIELD

The present invention relates to an iron type golf club head and a set of iron type golf clubs excellent in flight distance performance.

BACKGROUND ART

The following Patent Document 1 discloses an iron type golf club head in which a weight member is attached to a sole of a main body of the head and extends in the toe-heel direction of the head. The weight member integrally includes a toe-side portion and a heel-side portion, and the toe-side portion extends from the sole into a back portion of the head. The heel-side portion extends only in the sole. Such iron type golf club head can provide a lower and deeper center of gravity of the head.

Patent Document 1: Japanese Patent Application Publication No. 2018-000471

SUMMARY OF THE INVENTION

Problems to be Solved by the Invention

In general, when a golf ball is hit by an iron type golf club at the sweet spot of the club face, a long flight (driving) distance can be obtained.

Incidentally, the sweet spot is, as well known in the art, a point on the club face at which a straight line, which is drawn perpendicularly to the club face from the center of gravity G of the head, intersects the club face.

On the other hand, many golfers try to hit a golf ball at a middle point in the toe-heel direction of the face lines (or score lines) formed in the club face because such middle point is easily recognizable when addressing the ball. Further, an iron type golf club often hits a golf ball placed directly on the ground. Therefore, in order to improve the flight (driving) distance performance of an iron type golf club head, it is important to bring the sweet spot close to the middle point in the toe-heel direction of the face lines and also to lower the position of the sweet spot.

On the other hand, an iron type golf club head has a hosel portion having a relatively heavy weight. Thereby, the center of gravity of the head occurs on the heel-side of the middle point in the toe-heel direction of the face lines. Therefore, in order to provide an iron type golf club head with excellent flight distance performance, it is necessary to design the center of gravity of the head as close to the toe as possible.

Thus, in order to shift the center of gravity of the head toward the toe, it is required to add a large weight member in a toe-side of the sole portion.

In the case of an iron type golf club head, however, the sole portion is usually formed so as to extend upward as the position approaches to the toe. For this reason, when trying to arrange a weight member toward the toe as much as possible, the weight member will be arranged at a higher position. This results in a problem such that the position of the center of gravity of the head becomes higher and the position of the sweet spot also becomes higher.

In view of the above problem, the present invention was made, and a primary objective of the present invention is to provide an iron type golf club head and an iron type golf club set in which the center of gravity of the head is positioned toward the toe and deeper from the club face, while maintaining the center of gravity of the head at a low position.

According to the present invention, an iron type golf club head has a club face provided with face lines extending in the toe-heel direction of the head, and comprises a head main body and an external weight member secured to a sole portion of the head main body and extending in the toe-heel direction, wherein the specific gravity of the external weight member is larger than the specific gravity of the head main body, the center of gravity of the external weight member is located on a toe-side of the middle point in the toe-heel direction of the face lines, wherein the external weight member comprises a wide portion and a narrow portion where the width of the external weight member in the front-back direction of the head is larger in the wide portion than in the narrow portion, the wide portion is located on the toe side of the middle point in the toe-heel direction of the face lines, and the narrow portion is located on a heel side of the wide portion, wherein the wide portion has a first edge on a club face side which extends along a leading edge of the sole portion, the narrow portion has a second edge on the club face side which extends along the leading edge of the sole portion, and the first edge is located on the club face side than the second edge.

The wide portion may be disposed such that the extent in the toe-heel direction of the wide portion includes the position in the toe-heel direction of a most toe-side end of the face lines.

The narrow portion may be disposed such that the extent in the toe-heel direction of the narrow portion includes the position in the toe-heel direction of the middle point in the toe-heel direction of the face lines.

The width of the wide portion measured at the position in the toe-heel direction of the most toe-side end of the face lines may be not less than 1.35 times the width of the narrow portion measured at the position in the toe-heel direction of the middle point in the toe-heel direction of the face lines, both widths measured in the front-back direction of the head.

The width of the wide portion measured at the position in the toe-heel direction of the most toe-side end of the face lines may be 23 mm or more.

An internal weight member having a specific gravity greater than that of the external weight member, may be disposed between the head main body and the external weight member, wherein, in the toe-heel direction of the head, the center of gravity of the internal weight member is located on the toe side of the middle point in the toe-heel direction of the face lines.

The iron type golf club head may comprises a height of the sweet spot of the club face which is less than 19 mm, a depth of the center of the gravity of the head which is not less than 8 mm, and a distance in the toe-heel direction between the sweet spot and the middle point in the toe-heel direction of the face lines which is less than 4 mm.

According to another aspect of the present invention, an iron type golf club set includes a plurality of iron type golf clubs having different loft angles and respectively comprising the iron type golf club heads as described above, wherein the distance in the toe-heel direction of the head between the center of gravity of the external weight member and the middle point in the toe-heel direction of the face lines becomes larger as the loft angle becomes smaller.

The iron type golf club head according to the present invention includes the head main body and the external weight member extending in the toe-heel direction in the sole portion of the head main body, and the specific gravity of the external weight member is larger than the specific gravity of the head main body. Therefore, the iron type golf club head according to the present invention can provide a low position for the center of gravity of the head. The lowered center of gravity of the head lowers the position of the sweet spot.

By lowering the position of the sweet spot, the sweet spot approaches to the ball hit position in such a situation that the iron type golf club head hits the ball placed directly on the ground. This helps to increase the flight distance of the hit ball.

In general, due to the structural nature of the iron type golf club head, when a ball placed directly on the ground is hit, the ball hit position becomes lower than the sweet spot. As a result, when the ball hits the club face, the golf club head is liable to rotate toward such a direction that the club face inclines downward. However, by making the position of the sweet spot lower so as to approach the ball hit point, such rotation of the head can be suppressed, and as a result, the resultant decrease of the ball launch angle is also suppressed. This also helps to increase the flight distance of the hit golf ball.

The external weight member includes the wide portion and the narrow portion located on the heel side of the wide portion. The wide portion is located on the toe side of the middle point of the toe-heel direction of the face lines.

Such iron type golf club head can shift its center of gravity toward the toe, and as a result, the sweet spot approaches to the middle point of the face lines from the heel side. As the middle point of the face lines is a common hitting position of the golfers, the flight distance of the hit ball may be further increased.

Further, the first front edge of the wide portion is located closer to the club face than the second front edge of the narrow portion, and in the toe side of the sole portion, the wide portion extends in a wider range in the front-back direction. As a result, more weight can be distributed to the toe side of the head. This helps to shift the center of gravity of the head toward more toe-side.

Further, in the heel side of the sole portion, more weight can be distributed to the rear side of the head. This helps to shift the center of gravity of the head to a rear side of the head, increasing the depth of the center of gravity of the head from the club face.

As described above, in the iron type golf club head according to the present invention, the center of gravity of the head can be positioned toward the toe and to a deeper position from the club face, while maintaining the center of gravity of the head at a lower position.

DESCRIPTION OF THE PREFERRED EMBODIMENTS

Embodiments of the present invention will now be described in conjunction with accompanying drawings.

Figure 1:
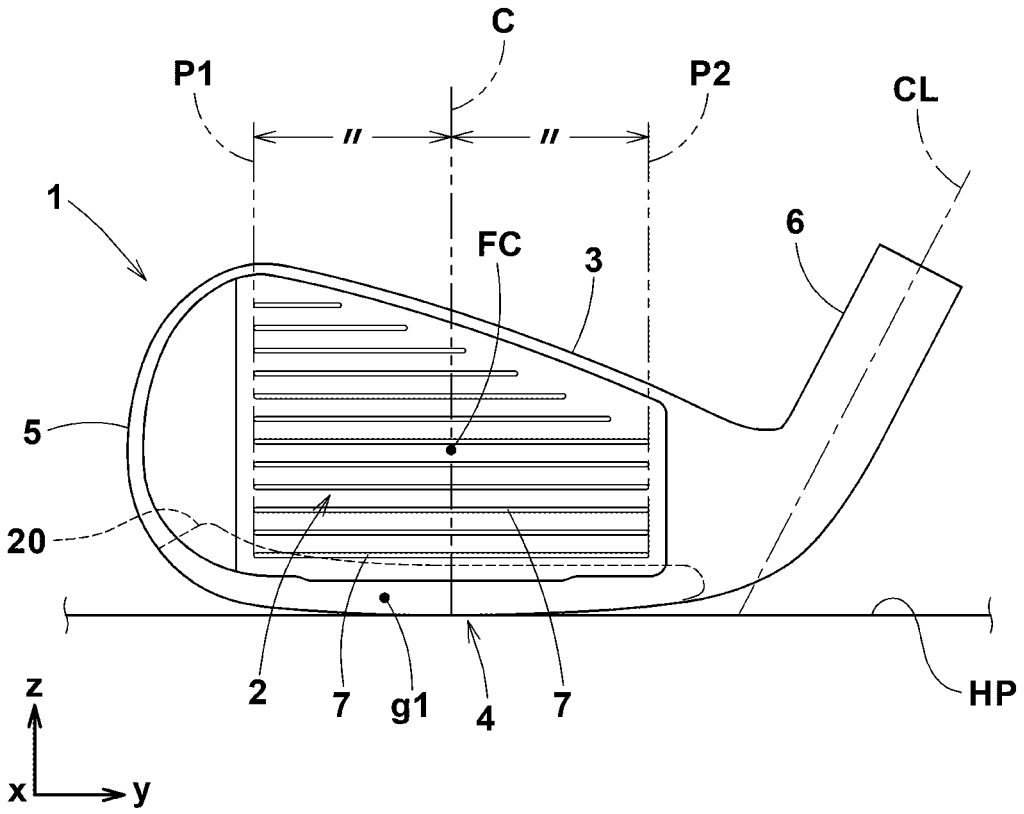
FIG. 1 is a front view of an iron type golf club head as an embodiment of the present invention.
Figure 2:
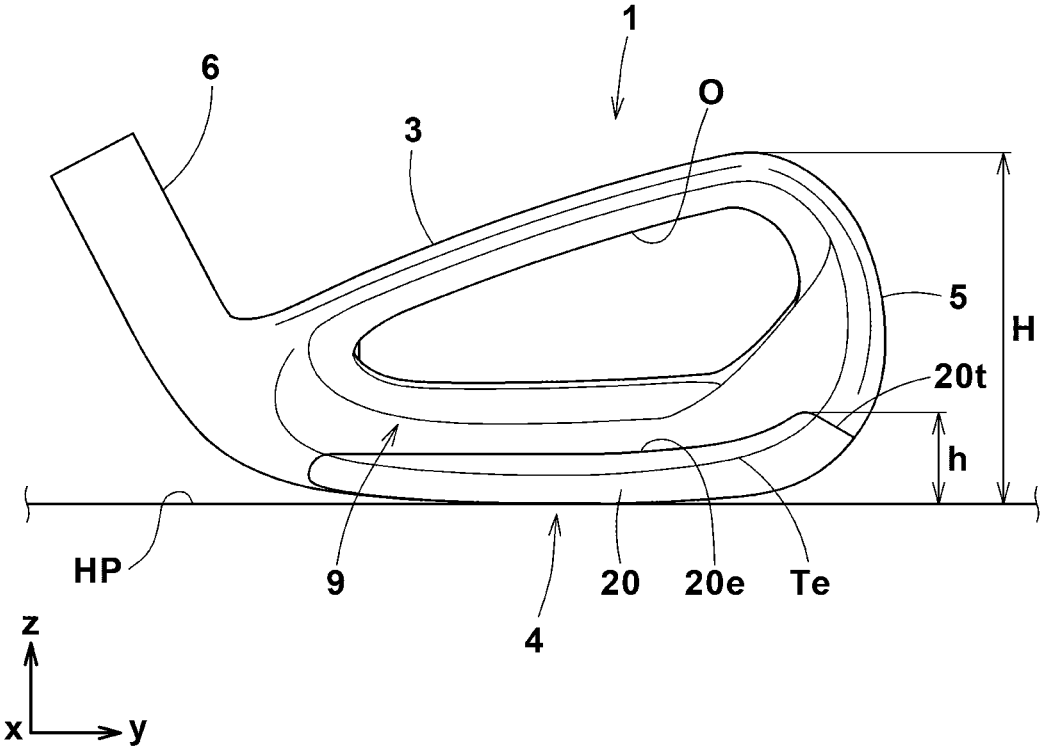
FIG. 2 is a rear view of the iron type golf club head shown in FIG. 1.
Figure 3:
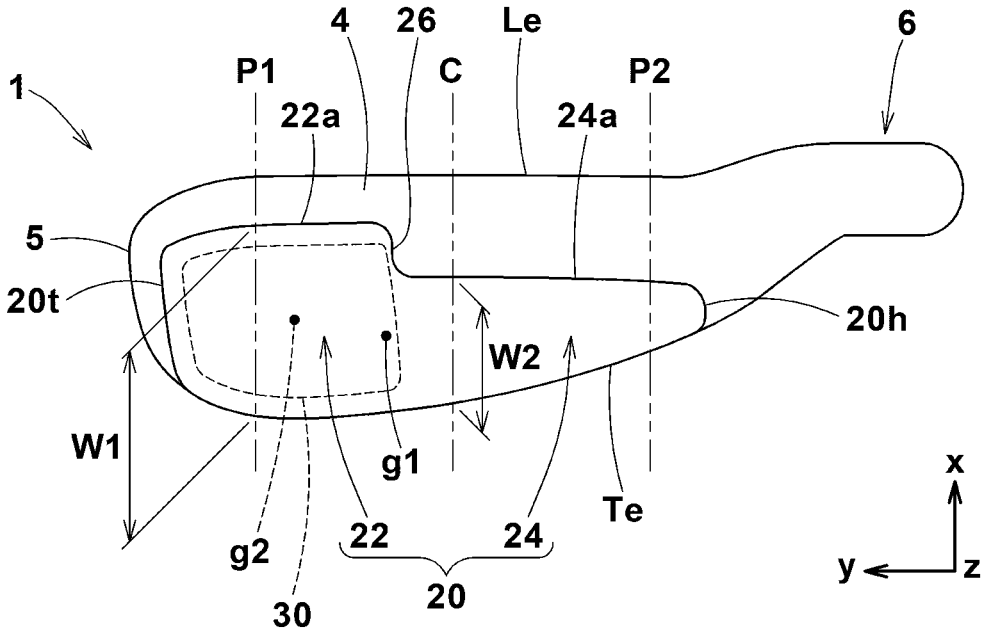
FIG. 3 is a bottom view of the iron type golf club head shown in FIG. 1.

FIGS. 1, 2 and 3 are a front view, a rear view and a bottom view, respectively, of an iron type golf club head 1 (hereinafter simply referred to as the "head" 1) as an embodiment of the present invention.

Figure 4B:
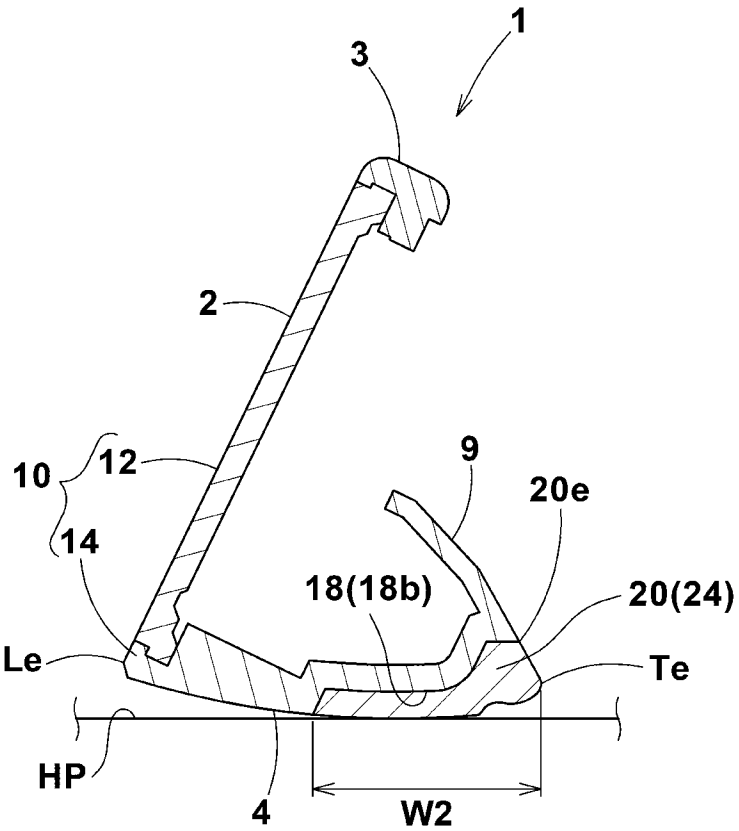
FIG. 4B is a cross-sectional view of the iron type golf club head of FIG. 1 taken at Position P1 in FIG. 1.
Figure 4A:
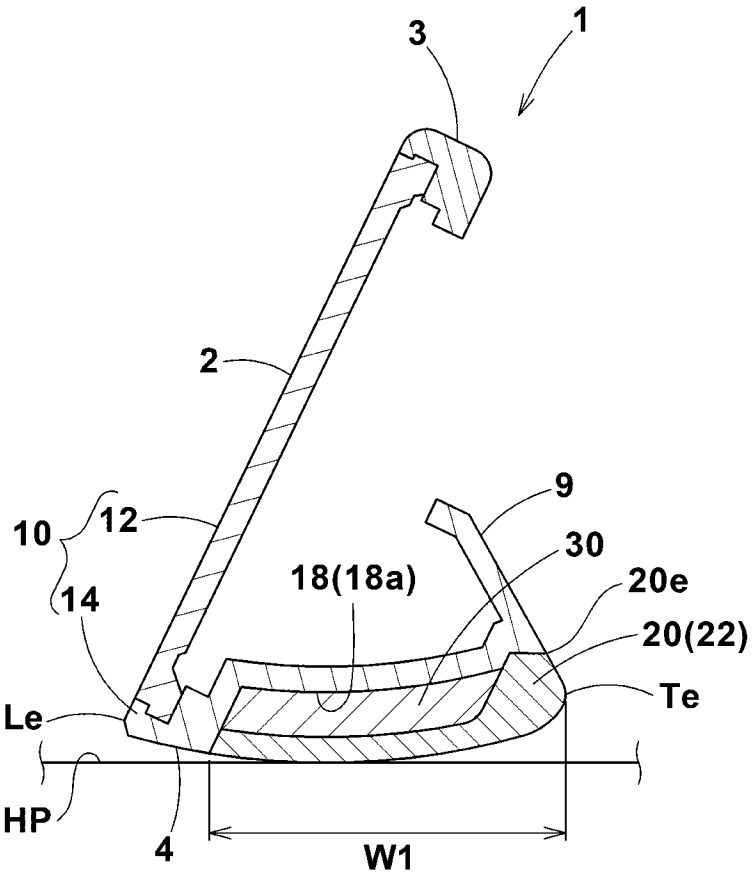
FIG. 4A is a cross-sectional view of the iron type golf club head of FIG. 1 taken at Position C in FIG. 1.

FIGS. 4A and 4B are cross-sectional views thereof taken at Positions P1 and C in FIG. 1, respectively.

Figure 5:
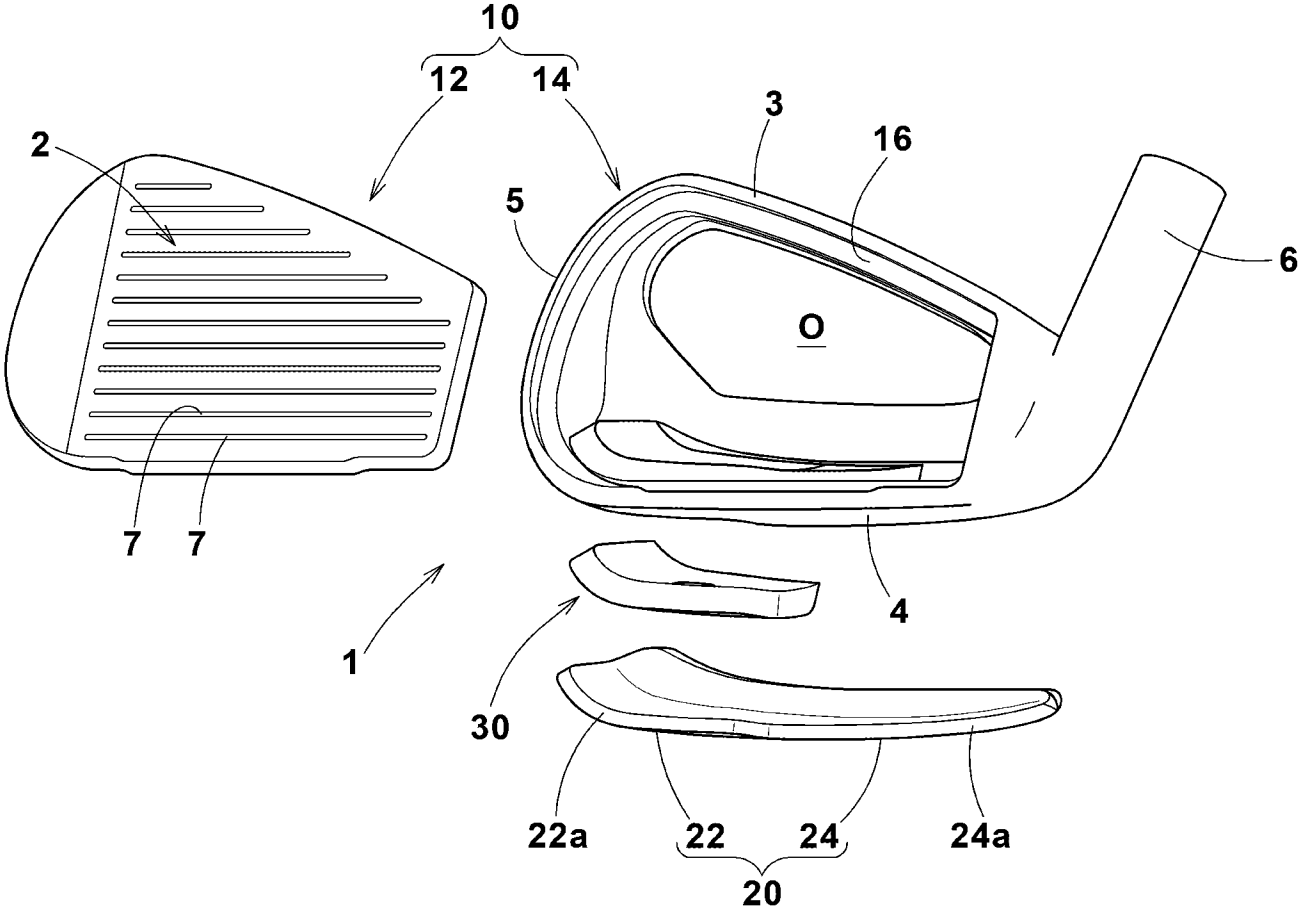
FIG. 5 is an exploded perspective view of the iron type golf club head in the present embodiment as viewed from the front.
Figure 6:
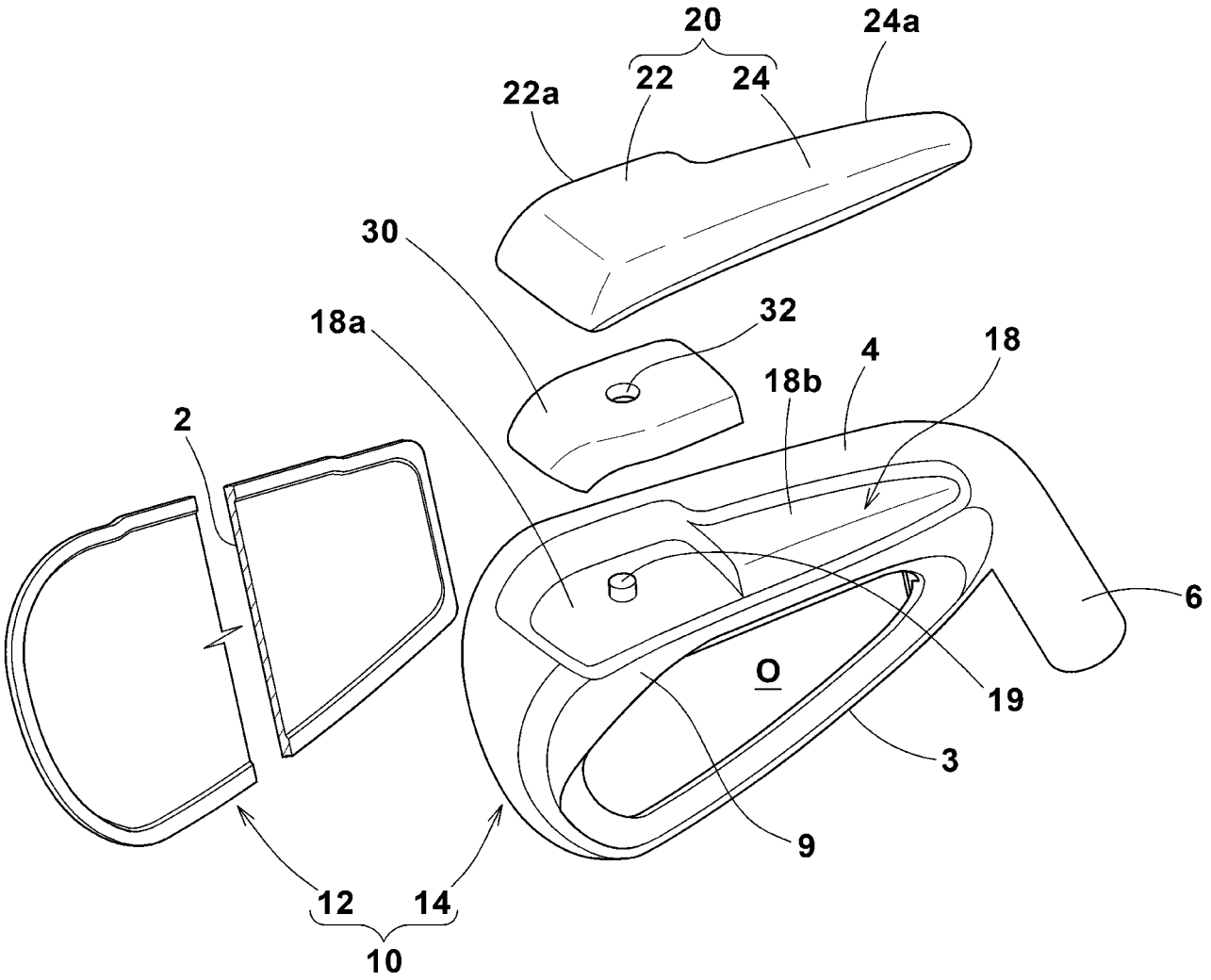
FIG. 6 is an exploded perspective view of the iron type golf club head in the present embodiment as viewed from below.

FIGS. 5 and 6 are exploded perspective views of the head 1 shown in FIG. 1.

In this application including the description and claims, dimensions, positions, directions and the like relating to the club head refer to those under a reference state of the club head unless otherwise noted.

Figure 10:
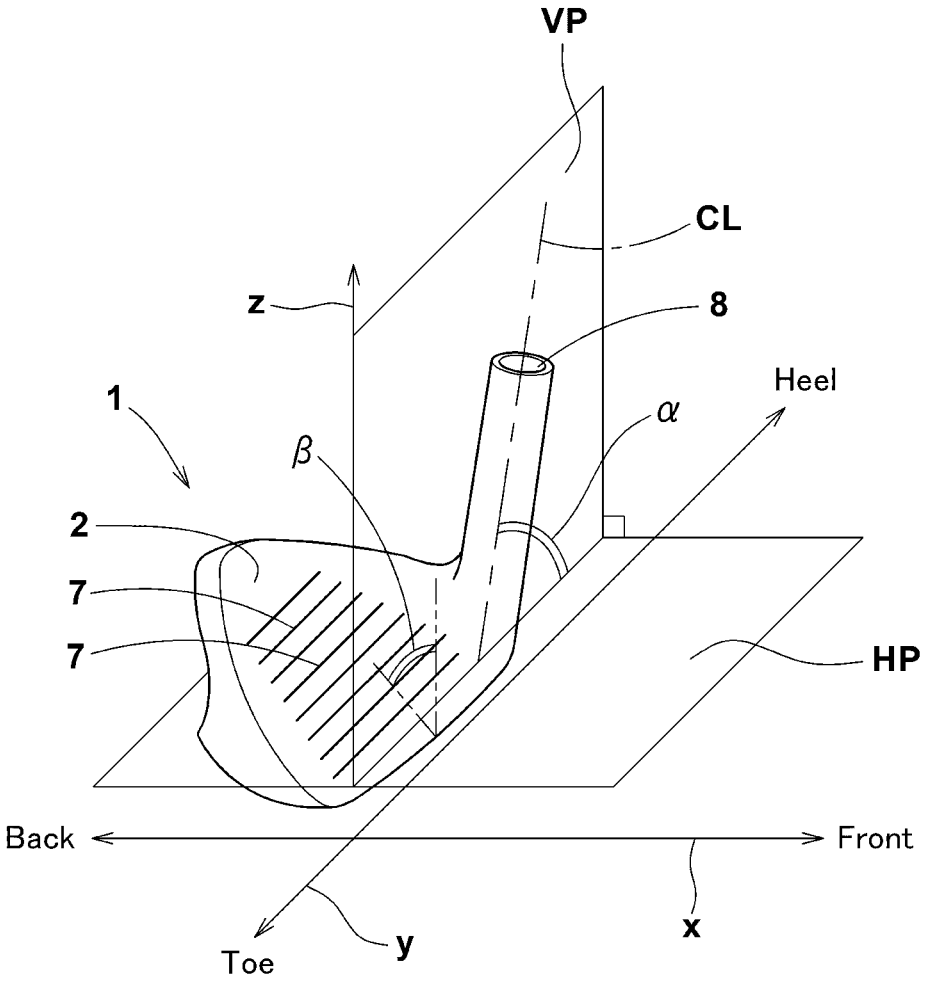
FIG. 10 is a schematic perspective view for explaining a reference state of an iron type golf club head.

As shown in FIG. 10, the reference state is a state of the head which is set on a horizontal plane HP so that face lines 7 formed in the club face 2 of the head become parallel to the horizontal plane HP, the center line CL of the club shaft inserting hole 8 of the head (corresponding to the axis of the club shaft) lies within a vertical plane VP perpendicular to the horizontal plane HP, and the face lines 7 become parallel to the horizontal plane HP and parallel to the vertical plane VP.

In the reference state of the club head, the following orthogonal directions are defined as shown in FIG. 10:

"Toe-heel direction" is a direction y parallel to the horizontal plane HP and parallel to the vertical plane VP;

"up-down direction" is a direction z perpendicular to the horizontal plane HP; and "Front-back direction" is a direction x orthogonal to the direction y and the direction z.

In the reference state, the center line CL is inclined at the specified lie angle $\alpha$ with respect to the horizontal plane HP, and the club face 2 is inclined at the specified loft angle $\beta$ with respect to the vertical plane VP.

In the present embodiment, the head 1 has a shape of a typical iron club head as shown in FIGS. 1 to 6, and the head 1 comprises a club face 2, a top portion 3, a sole portion 4, and a toe portion 5, a hosel portion 6 and a back portion 9.

The club face 2 is a substantially flat surface for striking a ball.

The club face 2 is provided with face lines (or grooves) 7 in order to increase the friction between the club face 2 and the ball. The face lines 7 extend parallel with each other and parallel to the toe-heel direction y of the head 1.

The top portion 3 is an upper surface part of the head 1 extending backward from the upper edge of the club face 2.

The sole portion 4 is a lower surface part of the head 1 defined between a leading edge Le and a trailing edge Te in the bottom view of the head as shown in FIG. 3.

The leading edge Le is at a position where the club face 2 and the lower surface part of the head 1 intersect with each other in a cross section of the head perpendicular to both the vertical plane VP and the horizontal plane HP.

The trailing edge Te is at a position where the lower surface part of the head 1 and the back portion 9 intersect with each other in the above-said cross section of the head. If such demarcation position can be identified from the appearance by a clear edge, the trailing edge Te is defined by the clear edge.

If there is no clear edge in the appearance, then the radius of curvature of the contour of the sole portion 4 is measured in the above-said cross section of the head, to find the position at which the radius of curvature first becomes less than 15 mm in the course from the leading edge Le side toward the rear of the head. The trailing edge Te can be defined as existing at the found position.

The back portion 9 is a rear surface part of the head 1 extending upwardly from the trailing edge Te of the sole portion 4.

The toe of the head is a farthest point from the hosel portion 6, and the toe portion 5 is a surface part of the head 1 including the toe and smoothly connecting between the top portion 3 and the sole portion 4.

The hosel portion 6 is a part of the head provided with a club shaft inserting hole 8 (shown in FIG. 10) into which the tip end of a club shaft (not shown) is inserted.

The hosel portion 6 in this example is formed as a cylindrical tubular portion.

When the tip end of the club shaft (not shown) is inserted and secured into the club shaft inserting hole 8, the center line CL of the club shaft inserting hole 8 coincides with the axis of the club shaft.

In the present embodiment, as shown in FIGS. 4 to 6, the golf club head 1 is composed of a head main body 10 and an external weight member 20.

The head main body 10 constitutes a major part of the head 1, and in this example, comprises the club face 2, the top portion 3, the sole portion 4, the toe portion 5, the hosel portion 6 and the back portion 9.

The head main body 10 is made of one or more kinds of metal materials, for example.

Preferably, the head main body 10 includes a face plate 12 and a face plate receiving part 14 as shown in FIGS. 5 and 6.

Preferably, the face plate 12 and the face plate receiving part 14 are made of different metal materials.

For example, the face plate 12 is made of a metal material having the smallest specific gravity among metal materials constituting the golf club head 1.

For the face plate 12, a titanium alloy excellent in specific strength which has a specific gravity of 4.5 or less can be used preferably. This helps to position the center of gravity of the head more backward and downward as well as helps to increase a weight margin for adjusting the center of gravity of the head when designing the head.

The face plate receiving part 14 has a through hole penetrating the face plate receiving part 14 in the front-back direction of the head so as to be surrounded by the top portion 3, the sole portion 4 and the toe portion 5, and thereby having a front opening O.

The face plate receiving part 14 is provided around the opening O with a club face mounting portion 16 to which the peripheral portion of the face plate 12 is fitted and fixed. The opening O is closed by the face plate 12 fixed to the club face mounting portion 16.

In order to fix the face plate 12 and the face plate receiving part 14 together, various fixing means, for example, welding, brazing, adhesive, caulking and the like can be used alone or in combination.

In this embodiment, the face plate receiving part 14 integrally includes the hosel portion 6 as one body.

The face plate receiving part 14 is, for example, made of a metal material having a specific gravity greater than that of the face plate 12.

The face plate 12 is preferably made of an iron-based alloy, specifically stainless steel or carbon steel, as a metal material having basic strength and good workability, which has a specific gravity of more than 7.0, preferably 7.5 or more.

When the face plate receiving part 14 is made of a metal material having a specific gravity more than that of the face plate 12, the center of gravity of the head can be located further backward and lower.

The head main body 10 is not limited to the structure composed of two different kinds of materials. The head main body 10 may be composed of a single material or three or more kinds of materials.

When the head main body 10 is made of one kind of material, it is usually of a one-piece structure in which the face plate 12 and the face plate receiving part 14 are integrally formed as one piece or member. But, it may be of a multi-piece structure in which, for example, the face plate 12 and the face plate receiving part 14 made of the same material are formed separately and then fixed to each other.

When the head main body 10 is made of three or more kinds of materials, the head main body 10 may be of a multi-piece structure in which the face plate 12 is fixed to the face plate receiving part 14, for example, composed of two or more members. In this case, the face plate 12 and the members constituting the face plate receiving part 14 are respectively made of three or more kinds of materials different from each other.

In the sole portion 4 of the head main body 10 (specifically, the face plate receiving part 14 in this example), a reentrant portion 18 is formed for example as shown in FIGS. 4 and 6.

In the reentrant portion 18, an external weight member 20 is disposed.

The external weight member 20 is exposed to the outside of the head so as to form a part of the outer surface of the sole portion 4 as shown in FIGS. 3 and 4.

In the sole portion 4, the external weight member 20 extends in the toe-heel direction.

For example, the external weight member 20 has a substantially constant thickness as shown in FIG. 5.

For example, the external weight member 20 is made of a metal material having a specific gravity greater than that of the head main body 10, to help to bring the position of the center of gravity of the head closer to the position of the center of gravity of the external weight member 20.

Since the external weight member 20 is disposed in the sole portion 4 so as to be exposed to the outside of the head, it helps to lower the position of the center of gravity of the head.

Incidentally, when the head main body 10 is made of one kind of material, the specific gravity of the head main body 10 equals to the specific gravity of the material.

When the head main body 10 is made of plural kinds of materials having different specific gravities, the specific gravity of the head main body 10 equals to a weighted average obtained by weighting the specific gravities of the materials constituting the respective members by the volumes of the respective members.

Preferably, the external weight member 20 is made of a tungsten-nickel-iron alloy containing W, Ni and Fe.

The specific gravity of such tungsten-nickel-iron alloy can be increased by increasing the ratio of the content of w to the content of Fe in its chemical components.

Such alloy containing Fe may be welded to the head main body 10 made of an iron-based alloy such as soft iron or stainless steel. In the external weight member 20 in this example, the content of W is increased to the extent that its weldability to the head main body 10 is maintained.

The specific gravity of the external weight member 20 is not particularly limited as long as it is larger than that of the head main body 10, but it is preferably 8.0 or more, more preferably 9.0 or more.

As shown in FIGS. 1 and 3, the center of gravity g1 of the external weight member 20 is located on the toe side of the middle point C in the toe-heel direction y of the head 1 of the face lines 7.

In this example, the external weight member 20 extends in the toe-heel direction y across the middle point C of the face lines 7 as shown in FIG. 3.

The middle point C is a point in the toe-heel direction y which is, as shown in FIG. 1, at the same distance from the position P1 in the toe-heel direction y of the most toe-side end of the face lines 7 and from the position P2 in the toe-heel direction y of the most heel-side end of the face lines 7.

In FIG. 1, "FC" denotes the center of the club face which is the middle point in the up-down direction of the head, of the club face 2 at the middle point C in the toe-heel direction y of face lines 7.

By configuring the external weight member 20 as described above, it is possible to shift the center of gravity of the head toward the toe at a lower position. By lowering the position of the center of gravity of the head, the position of the sweet spot of the club face 2 is also lowered. Therefore, when the iron type golf club head hits a ball placed directly on the ground, the position of the sweet spot approaches to the ball hit position of the club face 20. This helps to increase the flight distance of the hit ball.

In general, when a ball placed directly on the ground is hit by an iron type golf club head, the ball hit position of the club face becomes lower than the sweet spot due to the structural nature of the iron type golf club head.

Therefore, from the hit ball, the head receives a force to rotate the head toward such a direction that the club face leans downward. By lowering the position of the sweet spot so as to approach to the ball hit position, it is possible to suppress such rotation of the head occurring at the time of hitting the ball. Thus, a decrease in the ball launch angle can be suppressed. This helps to increase the flight distance of the hit ball.

In addition, by shifting the center of gravity of the head toward the toe, in the toe-heel direction, the sweet spot approaches to the middle point C of the face lines 7 (namely, the position in the toe-heel direction y at which many golfers try to hit a ball), and as a result, the probability that the flight distance of the hit ball is further increased, is increased.

In order to achieve the above-described desirable position for the center of gravity g1 of the external weight member 20, the external weight member 20 is provided with a wide portion 22 and a narrow portion 24 as shown in FIG. 3.

The wide portion 22 has a large width W1 in the front-back direction x of the head.

The narrow portion 24 has a width W2 in the front-back direction x smaller than the width W1 of the wide portion 22.

In the case of the example of the external weight member 20 shown in FIG. 3, between the wide portion 22 and the narrow portion 24, there is formed a step 26 (an edge) which is available to delimit a border between the wide portion 22 and the narrow portion 24.

The step 26 in this example extends in the front-back direction x of the head on the toe side of the middle point C of the face lines 7.

Thus, in the external weight member 20 in this example, the wide portion 22 is located on the toe side of the middle point C of the face lines 7, and the narrow portion 24 is located on the heel side of the wide portion 22.

And the wide portion 22 has a greater weight than the narrow portion 24.

Therefore, the external weight member 20 can distribute more weight on the toe side than the heel side.

The wide portion 22 has a first edge 22*a* on the club face 2 side which extends along the leading edge Le.

The narrow portion 24 has a second edge 24*a* on the club face 2 side which extends along the leading edge Le.

In the head 1 in the present embodiment, the first edge 22*a* is located closer to the club face 2 than the second edge 24*a* as shown in FIG. 3.

In a toe-side part of the sole portion 4, therefore, it is possible to make the wide portion 22 extend in a wider range in the front-back direction x. This makes it possible to distribute more weight to a toe-portion side lower position of the head.

In a heel-side part of the sole portion 4, on the other hand, as the second edge 24*a* is located backward of the first edge 22*a*, it is possible to make the weight concentrate in a rear side part of the head.

With these effects, in the head 1 in the present embodiment, the center of gravity can be shifted toward the toe and to a lower position, therefore, it is possible to provide the head 1 having excellent flight distance performance.

As explained above, it is possible to shift the center of gravity of the head 1 toward the toe by using the wide portion 22.

But, it is difficult to position the center of gravity of the head on the toe side of the middle point C of the face lines 7 as far as it is premised that the position of the center of gravity of the head 1 is lowered while adopting a conventional iron type golf club head shape for the head 1.

Thus, the center of gravity of the head in the present embodiment is still positioned on the heel side of the middle point C.

It is preferable that, as shown in FIG. 3, the extent in the toe-heel direction y of the wide portion 22 includes the position P1 in the toe-heel direction y of an end in the toe-heel direction y of the face lines 7 which end is the most toe-side end among those of the face lines 7.

More preferably, the toe-side end 20*t* of the external weight member 20 is positioned on the toe side of the position P1. Thereby, more weight is distributed to the toe-side part of the sole portion 4.

It is preferable that, as shown in FIG. 3, the extent in the toe-heel direction y of the narrow portion 24 includes the position in the toe-heel direction of the middle point C of the face lines 7. More preferably, the narrow portion 24 extends across the middle point C. Thereby, in a heel-side part of the sole portion 4 than the middle point C, more weight is distributed to the rear of the head.

Preferably, the heel-side end 20*h* of the external weight member 20 is positioned on the heel side of the position P2 in the toe-heel direction y of the most heel-side end of the face lines 7.

The width W1 of the wide portion 22 measured in the front-back direction of the head at the position P1 is preferably not less than 1.35 times, more preferably not less than 1.40 times, still more preferably not less than 1.50 times the width W2 of the narrow portion 24 measured in the front-back direction of the head at the middle point C. Thereby, the center of gravity of the head can be positioned toward more toe-side.

The width W1 of the wide portion 22 is preferably not less than 23 mm, more preferably not less than 25 mm, still more preferably not less than 26 mm in order to position the center of gravity of the head toward more toe-side.

The upper limit of the width W1 is not particularly limited, but it may be arbitrarily determined within the range of the width in the front-back direction x of the toe-side part of the sole portion 4 where the wide portion 22 is disposed.

The external weight member 20 has a third edge 20*e* on the rear side of the head 1 as shown in FIG. 2. The third edge 20*e* extends in the toe-heel direction along the trailing edge Te. The third edge 20*e* extends in the toe-heel direction above the trailing edge Te. The third edge 20*e* extends in the toe-heel direction smoothly along the trailing edge Te.

In order to distribute more weight toward the toe, the external weight member 20 comprises an end portion (20*t*) in the toe-heel direction y on the toe-side which extends upward slightly and then terminates. As shown in FIG. 2, the end portion (20*t*) extends along the contour of the toe portion 5.

In order to maintain the lowered position of the center of gravity of the head, as shown in FIG. 2, the maximum height h of the external weight member 20 from the horizontal plane HP is preferably set to be not more than 35%, more preferably not more than 30% of the maximum height H of the club face 2.

Further, as shown in FIGS. 5 and 6, an internal weight member 30 can be preferably disposed between the head main body 10 and the external weight member 20.

The internal weight member 30 in this example is secured between the head main body 10 (the reentrant portion 18) and the external weight member 20 as shown in FIG. 4A, and covered with the external weight member 20. Thus, the internal weight member 30 is invisible from the outside of the head.

The reentrant portion 18 of the head main body 10 in this example includes, as shown in FIG. 4A and FIG. 6, a deep first reentrant portion 18*a* accommodating the internal weight member 30, and a shallower second reentrant portion 18*b* not accommodating the internal weight member 30.

As shown in FIG. 4B, the external weight member 20 (the narrow portion 24) substantially fits the second reentrant portion 18*b*.

The internal weight member 30 is made of a metal material having a specific gravity greater than that of the external weight member 20.

Preferably, the internal weight member 30 is made of a tungsten-nickel-iron alloy containing W, Ni and Fe.

The specific gravity of the internal weight member 30 is not particularly limited, but preferably set to be not less than 11.0, more preferably not less than 12.0.

Preferably, the specific gravity of the internal weight member 30 is set to be not more than 18.5.

In this example, the tungsten-nickel-iron alloy whose specific gravity is increased by increasing the proportion of w up to such an extent that it cannot be welded to the head main body 10, is used for the internal weight member 30.

The position in the toe-heel direction y of the center of gravity g2 of the internal weight member 30 is located on the toe side of the middle point C of the face lines 7 as shown in FIG. 3. Such arrangement helps to position the center of gravity of the head more toe-side.

Preferably, the entire internal weight member 30 is disposed on the toe side of the middle point C of the face lines 7.

In this example, as shown in FIG. 6, the internal weight member 30 is provided with a through hole 32, and the above-mentioned first reentrant portion 18*a* of the head main body 10 is provided with a protrusion 19 at a position corresponding to the through hole 32.

When the internal weight member 30 is set in the first reentrant portion 18*a*, the protrusion 19 fits into the through hole 32. Since the internal weight member 30 fits to the reentrant portion 18, and the through hole 32 fits to the protrusion 19, accurate positioning of the internal weight member 30 is possible.

In order to fix the internal weight member 30 to the head main body 10, a weld bead (not shown) may be utilized when the internal weight member 30 cannot be welded to the head main body 10. The weld bead (not shown) is disposed between the through hole 32 and the protrusion 19. The weld bead fills the gap formed between the through hole 32 and the protrusion 19, and by the friction or mechanical engagement therebetween, the internal weight member 30 is prevented from moving relatively to the head main body 10. The weld bead is a hardened molten metal, and in this example, fused with the metal material of the protrusion 19, namely, the metal material of the head main body 10. Therefore, the vibration of the internal weight member 30 relative to the head main body 10 is suppressed, and the generation of abnormal noise due to the vibration is suppressed.

Owing to the above-described configuration of the head 1, the center of gravity of the head can be positioned toward the toe and to a deeper position from the club face, while maintaining a lowered position.

Figure 7A:
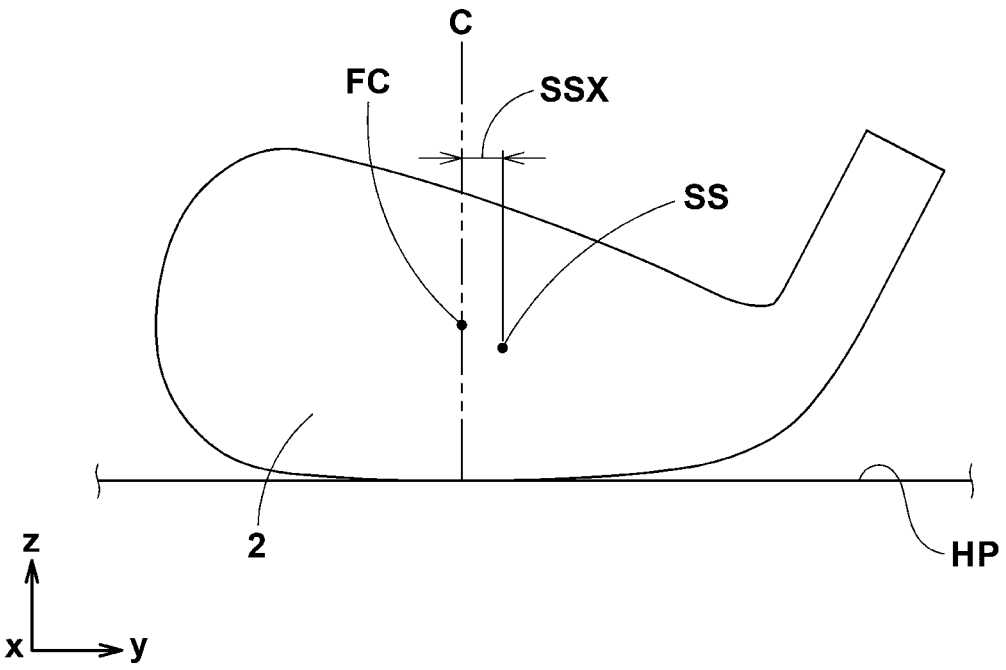
FIG. 7A and FIG. 7B are a schematic front view and a schematic cross-sectional view of an iron type golf club head.
Figure 7B:
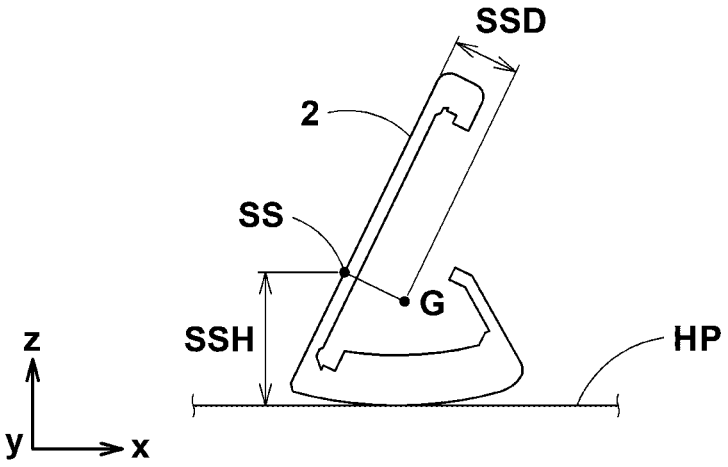

And it is preferred that, as shown in FIGS. 7A and 7B, the sweet spot height SSH is lower than 19 mm, the gravity center depth SSD is not less than 8 mm, and the distance SSX in the toe-heel direction between the sweet spot SS and the middle point C is less than 4 mm.

Here, the sweet spot height SSH is a vertical distance from the horizontal plane HP to the sweet spot SS.

The gravity center depth SSD is the shortest distance from the club face 2 to the center of gravity G of the head.

The distance SSX is indicated as plus (+) values when the sweet spot SS is on the heel side of the middle point C, and minus (−) values when the sweet spot SS is on the toe side of the middle point C.

According to another aspect of the present invention, there is provided an iron type golf club set (simply golf club set) including a plurality of iron type golf clubs (simply golf clubs) 100 having different loft angles β.

In this specification, an iron type golf club set refers to a group of iron type golf clubs intended to be sold in combination or recommended to do so by the manufacturer of the golf clubs.

The golf clubs 100 included in the golf club set have unified designs for example, and are configured to achieve different flight distances and heights respectively by the different loft angles β.

The golf club set includes at least a golf club 100 whose loft angle β is smallest and approximately 19 to 27 degrees, and a golf club 100 whose loft angle β is largest and approximately 44 to 60 degrees.

It is preferable that the difference in the loft angle β between the golf clubs 100 adjacent to each other with respect to the club number is approximately 3 to 10 degrees, and in order to cover a wide range of flight distances by the golf clubs 100 included in the golf club set, three or more, preferably four or more, more preferably five or more, and usually ten or less golf clubs 100 having different loft angles β are included in the golf club set.

As to the distances SSX of the respective golf clubs 100, it is preferable that the distances SSX are less than 4.0 mm, and the minimum among the values of the distances SSX is less than 1.0 mm, both in terms of the absolute value.

While detailed description has been made of preferable embodiments of the present invention, the present invention can be embodied in various forms without being limited to the illustrated embodiments.

Examples

Based on the structure shown in FIGS. 1 to 6, six types of iron type golf club heads having different loft angles were experimentally manufactured. Then, various dimensions and distances relating to the position of the center of gravity of each head were measured. The results are shown in Table 1.

TABLE 1

| | | external weight member width (mm) | | | distance | measured values relating to head's center of gravity (mm) | | |
|---|---|---|---|---|---|---|---|---|
| club number | loft angle (deg.) | position P2 | position C (W2) | position P1 (W1) | AX (mm) | distance SSX | sweet spot height SSH | gravity center depth SSD |
| #5 | 21 | 9.3 | 17.6 | 26.9 | 13.0 | 0.8 | 18.4 | 9.7 |
| #6 | 23 | 9.7 | 17.5 | 26.7 | 10.7 | 1.1 | 18.1 | 9.3 |
| #7 | 25 | 9.9 | 17.5 | 26.4 | 10.6 | 2.1 | 18.7 | 9 |
| #8 | 28 | 9.9 | 17.5 | 26.4 | 10.6 | 2.4 | 18.8 | 8.7 |
| #9 | 32 | 10.3 | 17.8 | 26.2 | 9.7 | 3.2 | 19.3 | 7.6 |
| PW | 37 | 6.8 | 17.4 | 23.9 | 8.2 | 3.5 | 20.4 | 6.7 |

Figure 8A:
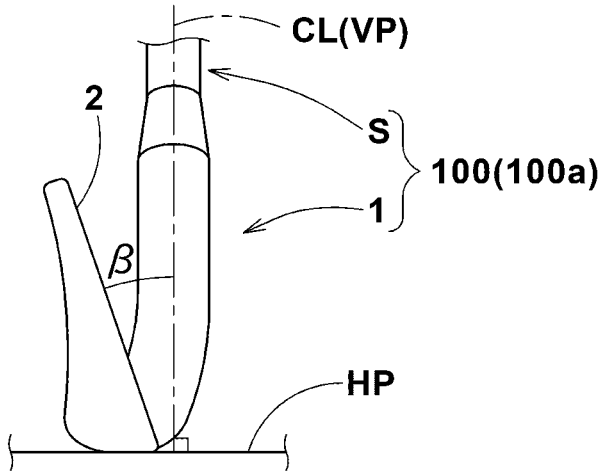
FIGS. 8A to 8C are partial side views of iron type golf clubs included in an iron type golf club set as an embodiment of the present invention as viewed from the toe-side.
Figure 8B:
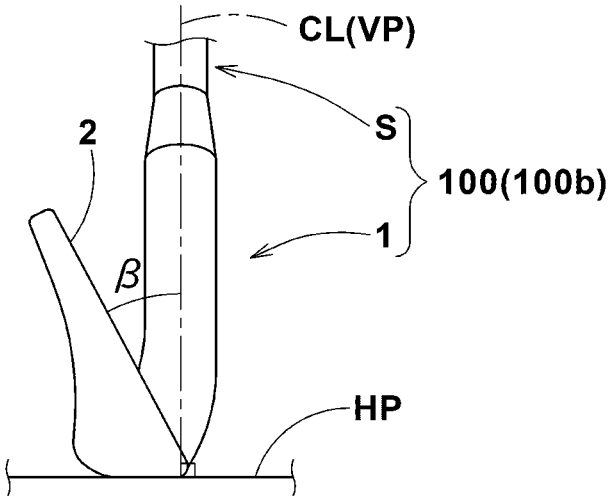
Figure 8C:
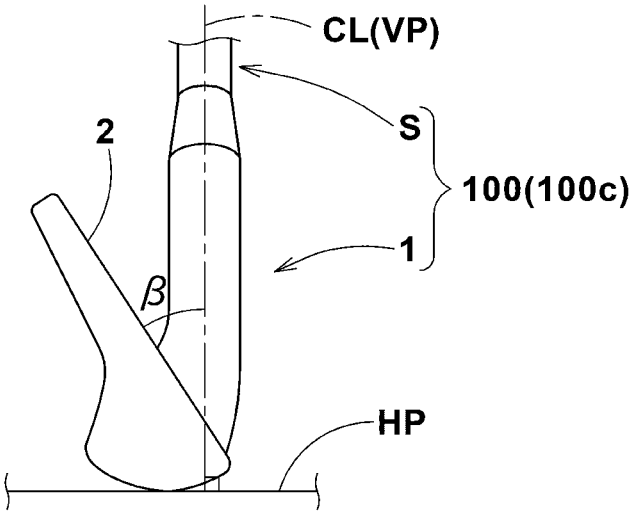

FIGS. 8A, 8B and 8C are side views of the golf clubs 100 (100*a*, 100*b* and 100*c*) included in the golf club set as an embodiment of the present invention, as viewed from the toe-side, showing their golf club heads under the respective reference states.

Figure 9A:
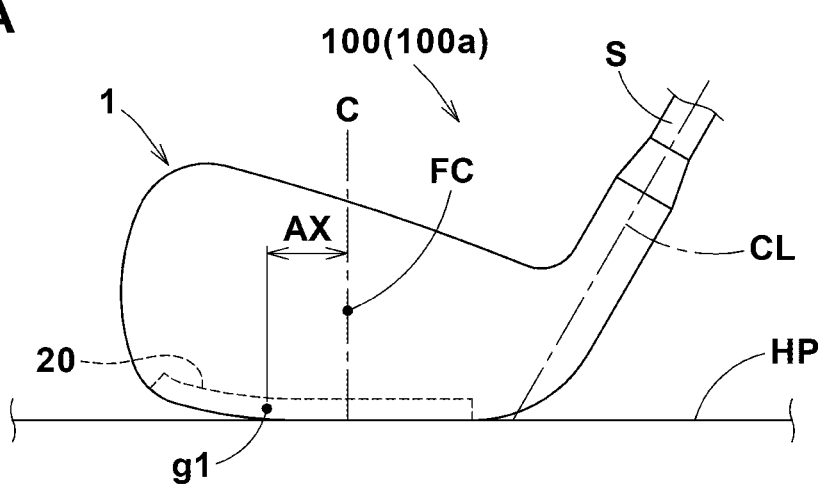
FIG. 9A to FIG. 9C are partial front views of the iron type golf clubs included in the iron type golf club set.
Figure 9B:
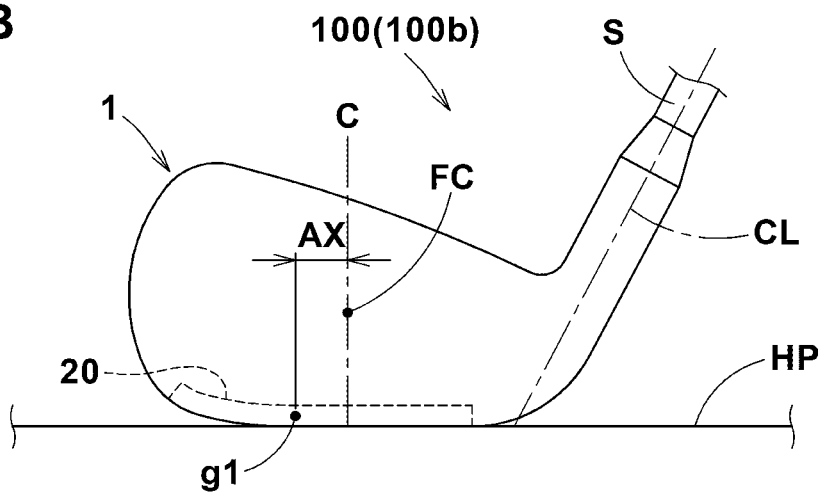
Figure 9C:
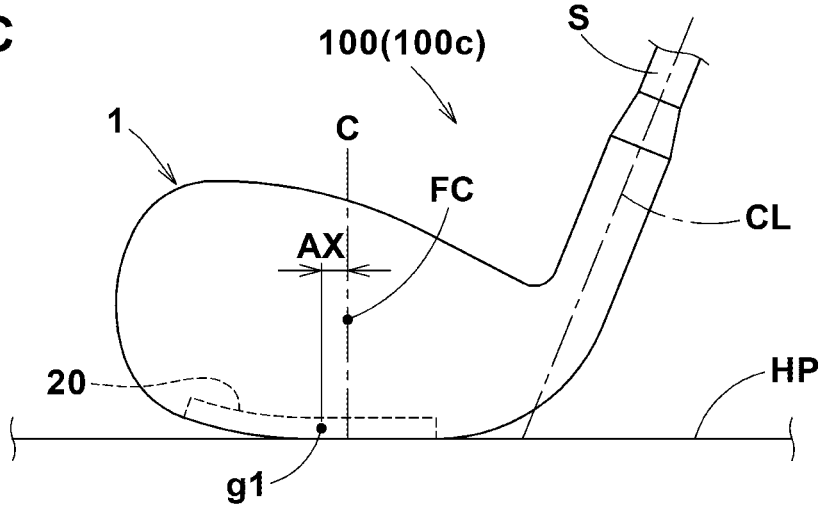

FIGS. 9A, 9B and 9C are front views of the golf club heads of the respective golf clubs 100*a*, 100*b* and 100*c*.

In term of the loft angle β, the golf club 100*b* is larger than the golf club 100*a* and smaller than the golf club 100*c* (100*a*<100*b*<100*c*).

As to the club number, the same relationship (100*a*<100*b*<100*c*) exists.

The golf clubs 100 included in the golf club set, include a plurality of golf clubs 100 each composed of the above-described head 1 comprising the external weight member 20 and a club shaft s. This means that the golf club set may include one or more golf clubs whose golf club head does not include the external weight member 20.

In the golf club set in this embodiment, with respect to the distance AX in the toe-heel direction y between the center of gravity g1 of the external weight member 20 and the middle point C in the toe-heel direction y of the face lines 7, the golf clubs 100 are configured such that the distance AX becomes larger as the loft angle β becomes smaller.

In general, a golf club 100 having a smaller loft angle β (so-called long iron) is required to provide a longer flight distance. Therefore, as in the present embodiment, by making the distance AX larger as the loft angle β becomes smaller, the sweet spot SS of the club face 2 becomes closer to the middle point C as the loft angle β becomes smaller, and higher rebound performance can be obtained.

With the above-described arrangement, the golf clubs 100 are desirably configured such that the distance SSX (shown in FIG. 7A) in the toe-heel direction y between the sweet spot SS and the middle point C becomes smaller as the loft angle β becomes smaller.

As can be seen from Table 1, it was confirmed that, in the iron type golf club heads according to the present invention, the center of gravity of the head is positioned toward the toe and deeper from the club face, while maintaining the center of gravity of the head at a lower position.

DESCRIPTION OF THE REFERENCE SIGNS

1 iron type golf club head
2 club face
4 sole portion
5 toe portion
7 face line
10 head main body
20 external weight member
22 wide portion
22*a* first edge
24 narrow portion
24*a* second edge
30 internal weight member
100 golf club
C middle point in the toe-heel direction of the face lines
g1 center of gravity of the external weight member
g2 center of gravity of the internal weight member

The invention claimed is:

1. An iron type golf club head having a club face provided with face lines extending in a toe-heel direction of the head, and comprising a head main body and an external weight member secured to a sole portion of the head main body and extending in the toe-heel direction, wherein the specific gravity of the external weight member is larger than the specific gravity of the head main body, the center of gravity of the external weight member is located on a toe-side of a middle point in the toe-heel direction of the face lines, wherein the external weight member comprises a wide portion and a narrow portion where the width of the external weight member in a front-back direction of the head is larger in the wide portion than in the narrow portion, the wide portion is located on the toe side of the middle point in the toe-heel direction of the face lines, and the narrow portion is located on a heel side of the wide portion, wherein the wide portion has a first edge on a club face side which extends along a leading edge of the sole portion, the narrow portion has a second edge on the club face side which extends along the leading edge of the sole portion, and the first edge is located closer to the leading edge of the sole portion than the second edge in a bottom view of the golf club head, wherein the wide portion is disposed such that the extent in the toe-heel direction of the wide portion includes a position in the toe-heel direction of a most toe-side end of the face lines, wherein the narrow portion is disposed such that the extent in the toe-heel direction of the narrow portion includes the position in the toe-heel direction of the middle point in the toe-heel direction of the face lines, and wherein the width of the wide portion measured at the position in the toe-heel direction of the most toe-side end of the face lines is not less than 1.35 times the width of the narrow portion measured at the position in the toe-heel direction of the middle point in the toe-heel direction of the face lines.

2. The iron type golf club head according to claim 1, wherein the width of the wide portion measured at the position in the toe-heel direction of the most toe-side end of the face lines is 23 mm or more.

3. The iron type golf club head according to claim 1, wherein an internal weight member having a specific gravity greater than that of the external weight member, is disposed between the head main body and the external weight member, wherein, in the toe-heel direction of the head, the center of gravity of the internal weight member is located on the toe side of the middle point in the toe-heel direction of the face lines.

4. The iron type golf club head according to claim 1, which comprises a height of the sweet spot of the club face which is less than 19 mm, a depth of the center of the gravity of the head which is not less than 8 mm, and a distance in the toe-heel direction between the sweet spot and the middle point in the toe-heel direction of the face lines which is less than 4 mm.

5. An iron type golf club head having a club face provided with face lines extending in a toe-heel direction of the head, and comprising a head main body and an external weight member secured to a sole portion of the head main body and extending in the toe-heel direction, wherein the specific gravity of the external weight member is larger than the specific gravity of the head main body, the center of gravity of the external weight member is located on a toe-side of a middle point in the toe-heel direction of the face lines, wherein the external weight member comprises a wide portion and a narrow portion where the width of the external weight member in a front-back direction of the head is larger in the wide portion than in the narrow portion, the wide portion is located on the toe side of the middle point in the toe-heel direction of the face lines, and the narrow portion is located on a heel side of the wide portion, wherein the wide portion has a first edge on a club face side which extends along a leading edge of the sole portion, the narrow portion has a second edge on the club face side which extends along the leading edge of the sole portion, and the first edge is located closer to the leading edge of the sole portion than the second edge in a bottom view of the golf club head, wherein the wide portion is disposed such that the extent in the toe-heel direction of the wide portion includes a position in the toe-heel direction of a most toe-side end of the face lines, wherein the width of the wide portion measured at the position in the toe-heel direction of the most toe-side end of the face lines is 23 mm or more.

6. The iron type golf club head according to claim 5, wherein an internal weight member having a specific gravity greater than that of the external weight member, is disposed between the head main body and the external weight member, wherein, in the toe-heel direction of the head, the center of gravity of the internal weight member is located on the toe side of the middle point in the toe-heel direction of the face lines.

7. The iron type golf club head according to claim 5, which comprises a height of the sweet spot of the club face which is less than 19 mm, a depth of the center of the gravity of the head which is not less than 8 mm, and a distance in the toe-heel direction between the sweet spot and the middle point in the toe-heel direction of the face lines which is less than 4 mm.

8. An iron type golf club head having a club face provided with face lines extending in a toe-heel direction of the head, and comprising a head main body and an external weight member secured to a sole portion of the head main body and extending in the toe-heel direction, wherein the specific gravity of the external weight member is larger than the specific gravity of the head main body, the center of gravity of the external weight member is located on a toe-side of a middle point in the toe-heel direction of the face lines, wherein the external weight member comprises a wide portion and a narrow portion where the width of the external weight member in a front-back direction of the head is larger in the wide portion than in the narrow portion, the wide portion is located on the toe side of the middle point in the toe-heel direction of the face lines, and the narrow portion is located on a heel side of the wide portion, wherein the wide portion has a first edge on a club face side which extends along a leading edge of the sole portion, the narrow portion has a second edge on the club face side which extends along the leading edge of the sole portion, and the first edge is located closer to the leading edge of the sole portion than the second edge in a bottom view of the golf club head, wherein the wide portion is disposed such that the extent in the toe-heel direction of the wide portion includes a position in the toe-heel direction of a most toe-side end of the face lines, wherein the narrow portion is disposed such that the extent in the toe-heel direction of the narrow portion includes the position in the toe-heel direction of the middle point in the toe-heel direction of the face lines, and wherein the width of the wide portion measured at the position in the toe-heel direction of the most toe-side end of the face lines is 23 mm or more.

9. The iron type golf club head according to claim 8, wherein an internal weight member having a specific gravity greater than that of the external weight member, is disposed between the head main body and the external weight member, wherein, in the toe-heel direction of the head, the center of gravity of the internal weight member is located on the toe side of the middle point in the toe-heel direction of the face lines.

10. The iron type golf club head according to claim 8, which comprises a height of the sweet spot of the club face which is less than 19 mm, a depth of the center of the gravity of the head which is not less than 8 mm, and a distance in the toe-heel direction between the sweet spot and the middle point in the toe-heel direction of the face lines which is less than 4 mm.

11. An iron type golf club set including a plurality of iron type golf clubs having different loft angles and each comprising an iron type golf club head which has a club face provided with face lines extending in a toe-heel direction of the head, and comprises a head main body and an external weight member secured to a sole portion of the head main body and extending in the toe-heel direction, wherein the specific gravity of the external weight member is larger than the specific gravity of the head main body, the center of gravity of the external weight member is located on a toe-side of a middle point in the toe-heel direction of the face lines, wherein the external weight member comprises a wide portion and a narrow portion where the width of the external weight member in a front-back direction of the head is larger in the wide portion than in the narrow portion, the wide portion is located on the toe side of the middle point in the toe-heel direction of the face lines, and the narrow portion is located on a heel side of the wide portion, wherein the wide portion has a first edge on a club face side which extends along a leading edge of the sole portion, the narrow portion has a second edge on the club face side which extends along the leading edge of the sole portion, and the first edge is located closer to the leading edge of the sole portion than the second edge in a bottom view of the golf club head, wherein the distance measured in the toe-heel direction of the head between the center of gravity of the external weight member and the middle point in the toe-heel direction of the face lines becomes larger as the loft angle becomes smaller.

12. The iron type golf club set according to claim 11, wherein in each of the iron type golf club heads, the wide portion is disposed such that the extent in the toe-heel direction of the wide portion includes a position in the toe-heel direction of a most toe-side end of the face lines.

13. The iron type golf club set according to claim 12, wherein in each of the iron type golf club heads, the narrow portion is disposed such that the extent in the toe-heel direction of the narrow portion includes the position in the toe-heel direction of the middle point in the toe-heel direction of the face lines.

14. The iron type golf club set according to claim 13, wherein in each of the iron type golf club heads, the width of the wide portion measured at the position in the toe-heel direction of the most toe-side end of the face lines is 23 mm or more.

15. The iron type golf club set according to claim 14, wherein in each of the iron type golf club heads, an internal weight member having a specific gravity greater than that of the external weight member, is disposed between the head main body and the external weight member, wherein, in the toe-heel direction of the head, the center of gravity of the internal weight member is located on the toe side of the middle point in the toe-heel direction of the face lines.

16. The iron type golf club set according to claim 15, wherein in each of the iron type golf club heads, a reentrant portion is formed in the sole portion of the head main body, and the external weight member is disposed in the reentrant portion.

17. The iron type golf club set according to claim 16, wherein in each of the iron type golf club heads, the internal weight member is secured between the reentrant portion and the external weight member and covered with the external weight member.

18. The iron type golf club set according to claim 16, wherein in each of the iron type golf club heads, the reentrant portion of the head main body includes a deep first reentrant portion accommodating the internal weight member and a shallower second reentrant portion not accommodating the internal weight member.

19. The iron type golf club set according to claim 18, wherein in each of the iron type golf club heads, the internal weight member is provided with a through hole, the first reentrant portion is provided with a protrusion at a position corresponding to the through hole, and the internal weight member fits to the deep first reentrant portion, and the protrusion fits into the through hole.

* * * * *